US006261162B1

(12) United States Patent
Hirokawa et al.

(10) Patent No.: US 6,261,162 B1
(45) Date of Patent: Jul. 17, 2001

(54) POLISHING APPARATUS AND METHOD OF MANUFACTURING GRINDING PLATE

(75) Inventors: Kazuto Hirokawa, Chigasaki; Hirokuni Hiyama, Tokyo; Yutaka Wada, Chigasaki; Hisanori Matsuo, Fujisawa, all of (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 09/276,146

(22) Filed: Mar. 25, 1999

(30) Foreign Application Priority Data

Mar. 25, 1998 (JP) ..... 10-096881
Mar. 25, 1998 (JP) ..... 10-096882
Mar. 25, 1998 (JP) ..... 10-098326

(51) Int. Cl.[7] ..... B24B 5/00

(52) U.S. Cl. ..... 451/285; 451/287; 451/56; 451/53

(58) Field of Search ..... 451/259, 281, 451/287, 288, 56, 53

(56) References Cited

U.S. PATENT DOCUMENTS 3,891,409 * 6/1975 Keith, Jr. ..... 451/493
5,944,590 * 8/1999 Isobe et al. ..... 451/288
5,997,384 * 12/1999 Blalock ..... 451/287
6,015,337 * 1/2000 Hiyama et al. ..... 451/288

FOREIGN PATENT DOCUMENTS 60-242975 2/1985 (JP) .
9-47969 2/1997 (JP) .

* cited by examiner

*Primary Examiner*—M. Rachuba
(74) *Attorney, Agent, or Firm*—Wenderoth, Lind & Ponack, L.L.P.

(57) ABSTRACT

A grinding plate has abrasive particles dispersed uniformly. The grinding plate is made by applying ultrasonic vibration when dispersing the abrasive particles in an organic solvent containing a binder material. The grinding plate is fixed on a base section in a wetted state. The grinding plate is divided into a plurality of segments and is fixed to a flat surface of the base section, and the segments are separated by a given distance.

26 Claims, 24 Drawing Sheets

POLISHING APPARATUS AND METHOD OF MANUFACTURING GRINDING PLATE

BACKGROUND OF THE INVENTION

1. Field of the Invention

The present invention relates in general to a polishing apparatus for producing a flat and mirror polished surface on objects such as semiconductor wafers using a grinding plate fixed to a base section and a method of polishing using such a grinding plate.

2. Description of the Related Art

As the density of circuit integration in semiconductor devices becomes ever higher, circuit patterns are becoming finer and interline spacing is becoming narrower especially for patterns of extreme fine line width. Accompanying this trend, the depth of focus becomes very shallow in photolithography of circuit patterns, and it requires that the surface of the wafer placed at the focal plane of a stepper must be microscopically flat to produce the required degree of image sharpness. A method of obtaining a flat surface is to polish the object in a polishing apparatus.

A type of conventional polishing apparatus is comprised by a turntable having a polishing cloth and a top ring which presses and rotates against the turntable with a given pressure while the polishing object is held therebetween and supplying a polishing solution to the interface to produce a flat and mirror polished surface.

FIG. 1 shows the essential configuration of an example of a conventional polishing apparatus. The apparatus is comprised by a rotating turntable 5 having a polishing cloth 6 such as a urethane cloth 6; a top ring 1 holding an object 4 such as a semiconductor wafer, so as to press and rotate the object against the cloth 6; a spray nozzle 9 for supplying a polishing solution Q to the cloth 6. The top ring 1 is connected to a top ring shaft 8, and the top ring 1 holds a wafer 4 in contact with an elastic mat 2 such as polyurethane. The top ring 1 has a cylindrical guide ring 3 on its outer periphery so that the wafer 4 would not be disengaged from the bottom of the top ring 1. The guide ring 3 is fixed in position relative to the top ring 1, and the wafer 4 is held within the holding surface so that the wafer 4 would not jump outside of the top ring due to frictional forces with the cloth 6. The top ring 1 is supported on a spherical bearing 7 so that it can be tilted with respect to the shaft 8.

While holding the wafer 4 in the bottom surface of the elastic mat 2 of the top ring 1, wafer 4 is pressed against the cloth 6 on the turntable 5, and the turntable 5 and the top ring 1 are independently rotated so as to slide the wafer 4 relative to the cloth 6 to polish the wafer 4. In this case, polishing solution Q is supplied from the nozzle 9 to the top surface of the cloth 6. The polishing solution combines two effects of chemical and mechanical polishing (CMP), namely, chemical polishing by an alkaline solution, for example, and mechanical polishing using abrasive particles, for example silica particles, suspended in a solution.

However, the conventional polishing methods of CMP using such a slurry solution containing many abrasive particles presents two operational problems.

The first problem is that, depending on the pattern types and the difference in the elevation of the surface structures, a polished surface can result in surface waviness or undulations. In general, circuit patterns formed on a semiconductor wafer are comprised by various patterns having differing dimensions and elevations. These surface structures can include micro-structures of separation distance of the order of micrometers and height of 0.5–1 μm, and macro-structures of separation distance of the order of 100 μm to 1 mm. Surface films such as aluminum silicates and aluminum films are deposited on the wafers having such elevation differences, and when such a surface, having surface elevations polished, the polished surface will reproduce the base elevations. When such microscopically uneven surface is subjected to a CMP process, raised portions are removed together with the depressed portions of the surface, leading to a creation of surface undulations. It is considered that this phenomenon in CMP is created because a relatively soft cloth such as urethane is used along with abrasive particles of microscopic sizes contained in the polishing solution so that not only the raised portions but the depressed portion of the surface structure is also removed by such abrasive particles.

The second problem relates to cost and environmental considerations. The polishing solution is usually a slurry containing a fine silica or the like powder in suspension, but to obtain a uniformly flat surface of high quality, it is necessary to supply the solution in an abundant quantity to the polishing surface. However, most of the solution supplied is actually discharged in the spent solution without contributing much to the flattening process. Polishing solutions used for high precision polishing of semiconductor devices are expensive, which is a factor leading to a problem of high polishing cost. Also, because such polishing solution in a slurry condition contains a large quantity of silica or the like particles, the maintenance of the environment becomes difficult. That is, contamination of a solution supply system and drainage system by the slurry is serious, and the spent solution must also be treated extensively before being discarded. Also, after a CMP process, the wafers are washed to remove the polishing solution, but the waste water from this operation also must be treated in a similar manner and poses an environmental problem.

Therefore, instead of using a slurry on the polishing cloth, a method of using a grinding plate has been known. This method is based on a grinding plate comprised by silica or other abrasive particles bound in a flat ground platen, which is fixed on top of the polishing table. The wafer is polished while being pressed between the top ring and the grinding plate.

According to this method of polishing, because the grinding plate is harder than a cloth, only the raised portions of the surface are polished, thereby eliminating the problem of creating surface undulations described above. This means that precision polishing is possible, that is, to polish only those areas needed to be processed. Also, because a slurry containing a large amount of particles is not used, the processing cost can be low, and the environmental load can also be decreased.

SUMMARY OF THE INVENTION

It is an object of the present invention to provide a method and an apparatus for making a grinding plate having abrasive particles dispersed uniformly in the grinding plate.

The present method of making a grinding plate includes applying ultrasonic vibration when dispersing the abrasive particles in an organic solvent containing the binder material.

Ultra-fine particles are thus subjected to vibrational energy of ultrasonic vibration, and are dispersed extremely uniformly within the solvent containing the binder material. Therefore, individual particles are coated evenly with the binder material to produce a precursor material having the particles coated with the binder. By drying a slurry containing the precursor material, an intermediate material is obtained. By pulverizing the intermediate material, a powder material is obtained. The powder material is press molded to produce the grinding plate containing abrading material which had been coated with the binder material well dispersed therein. The use of such a grinding plate leads to precision polishing of an object to be polished, in other words, to remove material only from those areas of the object that need to be removed.

As explained above, by applying ultrasonic vibration during the step of mixing the abrasive particles and the binder material, the particles can be dispersed quite uniformly. Accordingly, a grinding plate having a microstructure of well dispersed abrasive particles can be produced.

It is another object of the present invention to provide a polishing apparatus and a polishing tool which is able to maintain a flat abrasive surface even when the polishing tool having the grinding plate is wetted by coming into contact with a liquid substance during polishing.

The above object has been achieved in a polishing apparatus for producing a flat and mirror polished surface on an object to be polished by pressing a surface of the polishing object on an abrasive surface, comprising: a grinding plate having an abrasive surface; a base section to support the grinding plate; a holding section for holding the object; and a sliding device for producing a relative sliding motion while pressing the surface of the object against the abrasive surface by means of the base section and the holding section of the grinding plate; wherein the grinding plate is fixed on the base section in a wetted state.

Accordingly, because the grinding plate is fixed on the base section in a wetted condition, when a liquid substance, such as water contacts, during polishing, the abrasive surface of the polishing tool installed in the polishing apparatus, no change takes place in the wetness of the grinding plate. Therefore, the grinding plate can maintain the flatness of the abrasive surface, which existed when the grinding plate was fixed to the base section in a water-infiltrated condition. Therefore, by using a polishing tool having a flat abrasive surface of the grinding plate in a wetted state, it is possible to produce a highly flat and mirror polished surface on the object.

The polishing apparatus may also be comprised by: a grinding plate and a base section for supporting the grinding plate; a holding section for holding the object; and a sliding device for producing a relative sliding motion while pressing the surface of the object against an abrasive surface of the grinding plate by means of the base section and the holding section; wherein the grinding plate is divided into a plurality of segments and is fixed to a flat surface of the base section, and the segments are separated by a given distance.

According to this type of polishing apparatus, because the plurality of segmented grinding plate pieces separated by a given distance are fixed to the bonding surface of the base section, stresses can be dispersed uniformly over the entire surface of the polishing tool to prevent bowing of the abrasive surface, thereby enabling precision polishing.

DETAILED DESCRIPTION OF THE PREFERRED EMBODIMENTS

Figure 1:
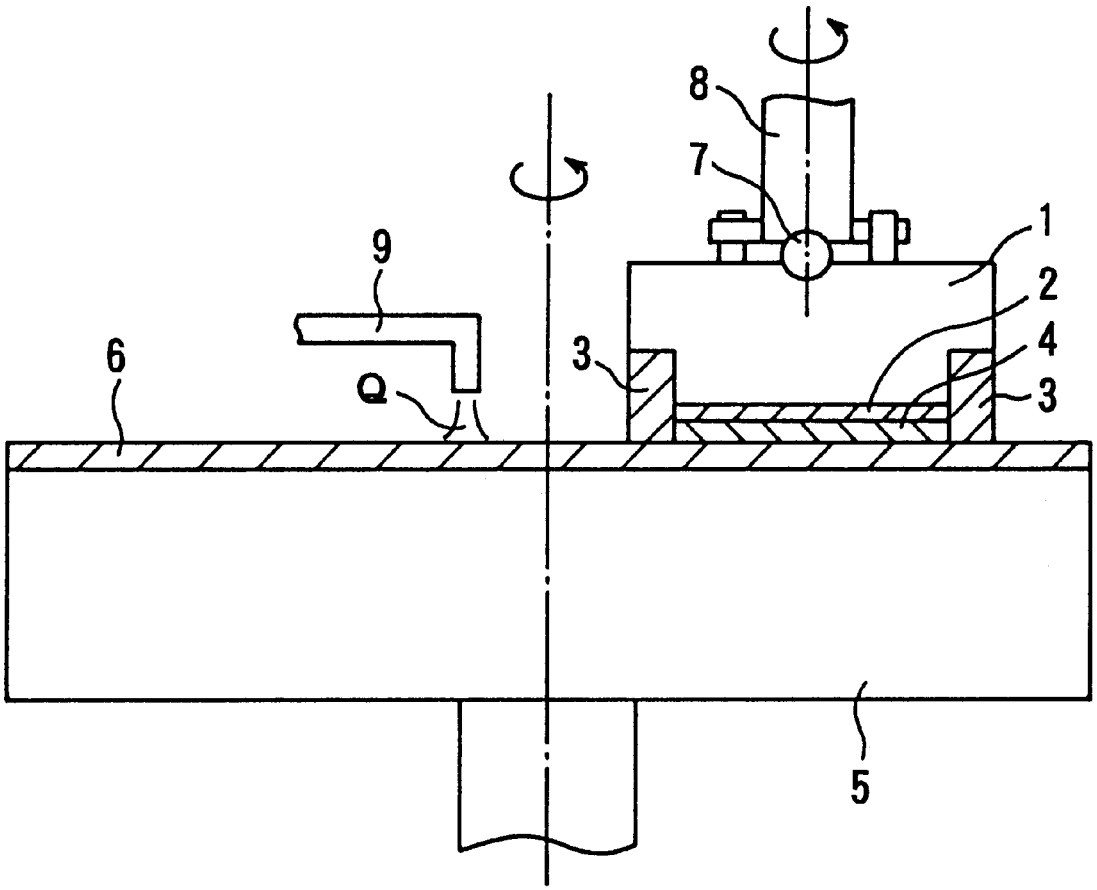
FIG. 1 is a schematic diagram of the essential parts of a conventional method of polishing using a polishing solution in a slurry.

FIG. 2 shows the first embodiment of a method of making a grinding plate by making an intermediate body first. As shown in FIG. 2A, an organic solvent 12 (ethanol for example) is readied in a container 11. A binder (phenol liquid) 13 is poured from a bottle 13*a*, thereby diluting the phenol binder with the organic solvent. Next, as shown in FIG. 2B, abrasive particles are mixed in the organic solution 12 containing diluted binder. First, a liquid 15, the binder 13 diluted with the organic solvent 12, is transferred from the container 11 to a stirring vessel 14. Abrasive particles 17 in a fine powder form are poured from the powder container 16 into the liquid 15 to produce a mixed liquid 15*a*. An example of the mixed liquid 15*a* is a silica powder of average particle size of 30 nm mixed in a ratio of 1 part powder to 8 parts of the liquid by weight.

Figure 2A:
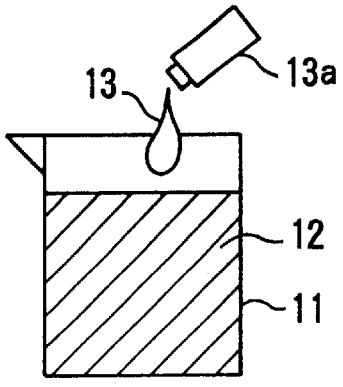
FIGS. 2A~2E are illustrations of an embodiment of a method of making a grinding plate.
Figure 2B:
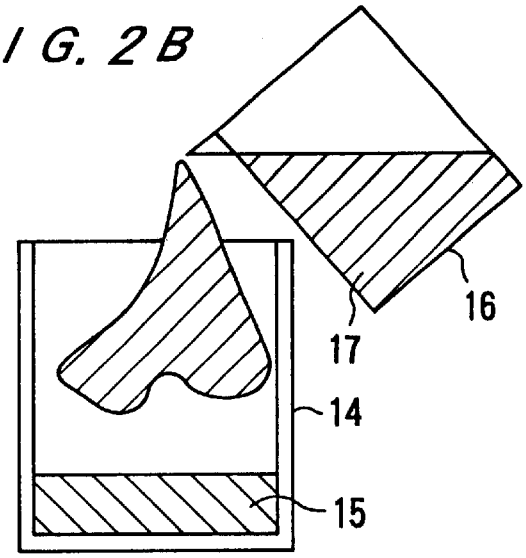
Figure 2C:
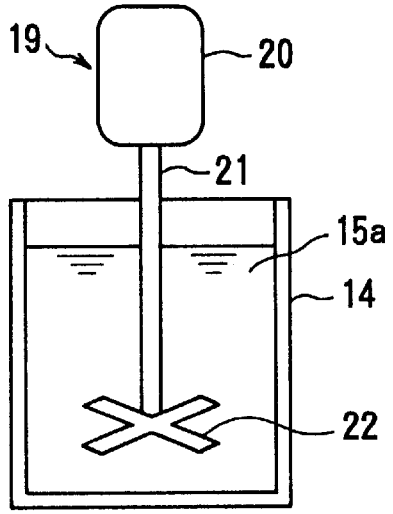

As shown in FIG. 2C, the mixed liquid 15*a* is stirred using a stirring device 19 to disperse the particles 17 uniformly in the organic solvent. The stirring device 19 is comprised by stirrer blades 22 and a main shaft 21 for attaching the stirrer blades 22, and a drive device 20 for rotating the main shaft 21. The stirrer blades 22 are placed in the center of the liquid 15*a* having the binder 13 and the abrasive particles 17, and the drive device 20 is operated to rotate the stirrer blades 22. Stirring is performed at a rotational speed of 3,000 r.p.m. for about 20 minutes. This process disperses the particles to a degree of uniformity.

However, the particles 17 are ultra-fine particles and tend to agglomerate and therefore are very difficult to disperse. Therefore, it is not necessarily mixed sufficient by using only the stirrer blades 22. Therefore, in this invention, the liquid 15*a* is subjected to ultrasonic vibration. Ultrasonic vibration can be carried out by attaching a transducer to the stirrer blades 22 to impart the vibration to the liquid 15*a* or it may be attached to the exterior of the vessel 14 to impress the vibration through the wall of the vessel 14. By applying ultrasonic vibrations thus to the liquid 15*a*, the particles are dispersed uniformly in the organic solution 15*a*. The process of vibration produces a slurry from the liquid 15*a*, and the individual dispersed particles become coated with the binder, and a precursor material having the abrasive particles coated well with the binder.

Figure 3:
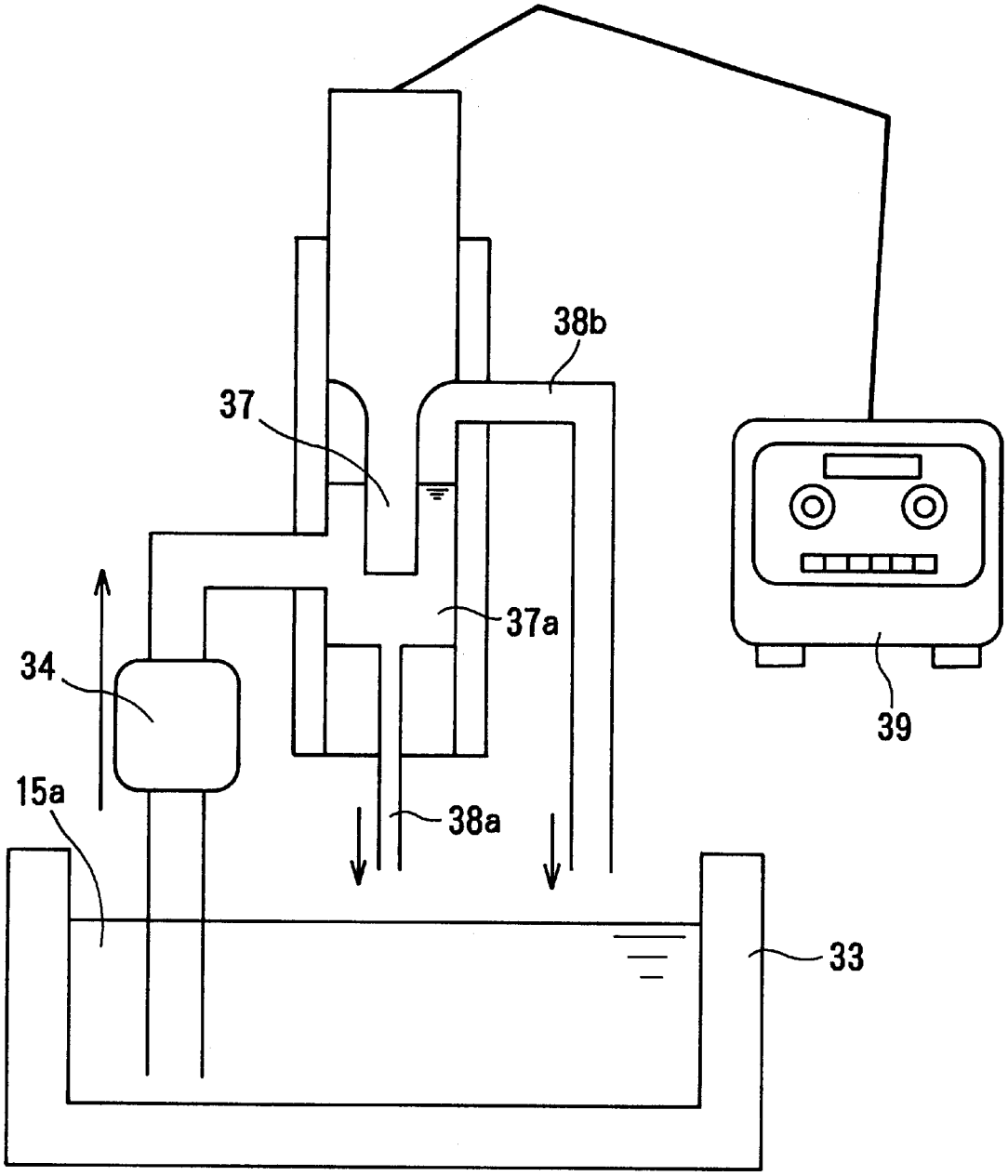
FIG. 3 is a side view showing employing an ultrasonic vibration generator during a mixing process.

The application of ultrasonic vibrations is preferably performed in a homogenizer such as the one shown in FIG. 3. This process is carried out by putting liquid mixture 15*a* of particles and binder material in a processing fluid tank 33, and introducing this liquid 15*a* by means of a circulation pump 34 from its spout into a processing space 37*a* equipped with an ultrasonic horn 37. Using this horn 37, ultrasonic vibration is applied to the mixture 15*a* under the command of a controller 39. Ultrasonic vibrations have an effect of dispersing the abrasive particles uniformly in the organic liquid 15*a* produced by diluting the binder. The liquid 15*a* having uniformly dispersed particles becomes a slurry, and is returned to the processing liquid tank 33 through a discharge port 38*a* or an overflow discharge port 38*b*.

The conditions for applying the ultrasonic vibration are: in a homogenizer with a continuous pulverizing cell having a maximum output power of 500 W, and operated at 20 kHz using a flow rate of 120 mL/min for about 30 minutes. These parameters are only by way of example, and it is necessary to adjust the parameters according to the nature of particles, binder materials, solvents, additives, volume and mixing ratios.

Figure 2D:
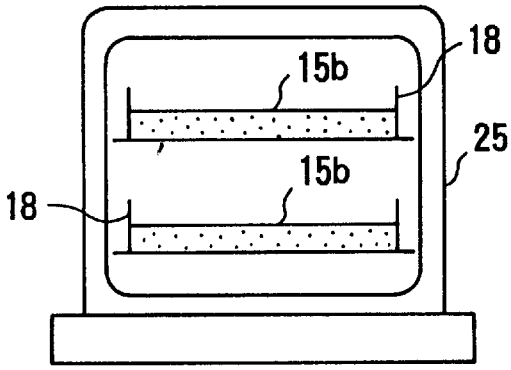

Next, as shown in FIG. 2D, the liquid 15*a* in a slurry condition having the particles well coated with the binder material are poured into a tray 18. The slurry is first air dried, and next, it is heated in a vacuum oven at 50° C. for about 2 hours to dry the liquid 15*a* to form intermediate solid material 15*b*. This drying process vaporizes the organic solvent within the liquid 15*a*, and a solid precursor material of particles 15*b* having the binder intimately fixed to the particles.

Figure 2E:
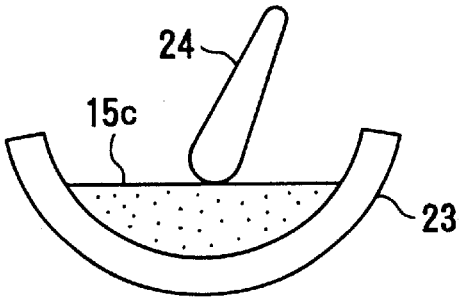

Next, as shown in FIG. 2E, the intermediate solid material 15*b* is pulverized to produce a powder material 15*c*. This process can be carried out using a mortar 23 and a pestle 24 to break up the intermediate material 15*b*, or a ball mill may be used. In either case, the intermediate material 15*b* is again powdered, and the process then proceeds to a stage of molding and heat treatment for the grinding plate.

Figure 4A:
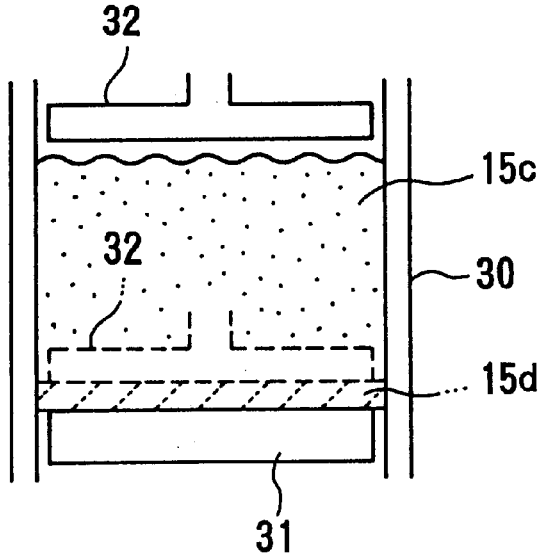
FIGS. 4A~4C are illustrations of a process of making a grinding plate.
Figure 4B:
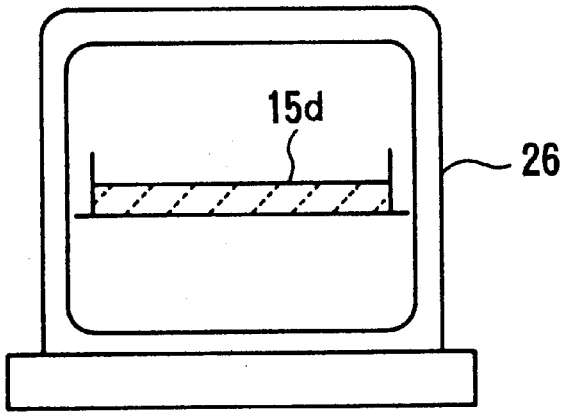
Figure 4C:
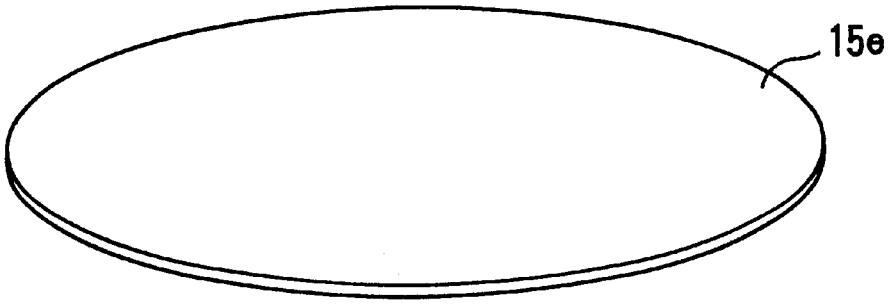

FIGS. 4A through 4C show a process of molding and heat treating of the grinding plate. FIG. 4A shows a press mold, FIG. 4B shows heat treatment and FIG. 4C shows a finished grinding plate. As shown in FIG. 4A, this process is carried out by placing the powder material 15*c*, having the particles coated with the binder, in a cylindrical mold 30. This powder material is pressed using a press plate 32. This process compresses the powder material 15*c* and forms a solid object 15*d*. This press molding process determined the shape of the grinding plate as illustrated in FIG. 4C. The press molded green body 15*d* is placed in a furnace 26 for heat treating. In this embodiment, heat treating is carried out at 180° C. for 2 hours, for example.

The heat treating softens (conversion to a gel) the binder, and fuses the binder adhering to the neighboring abrasive particles, thereby developing an overall strength of the grinding plate. The structural configuration of this grinding plate produces a dispersion of the abrasive particles without agglomerating, and the binder connects the particles throughout with an occluded void space represented by air bubbles. The void space is created by the air bubbles occluded in the powder material 15*c* during the press molding process.

Figure 5:
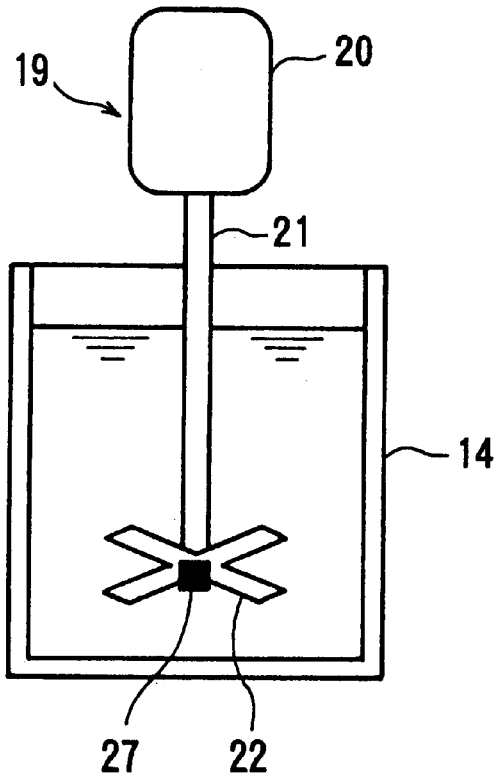
FIG. 5 shows an embodiment of the stirring device.

FIG. 5 shows an example of the stirring apparatus. This apparatus is for dispersing the particles in a liquid made by diluting the binder with an organic solvent in stirring vessel 14. The vessel 14 is comprised by stirrer blades, main shaft 21 connected to the stirrer, and drive device 20 such as motor for driving the main shaft 21. The drive device 20 is a variable speed drive and produces a rotational speed in a range between 0 and 3,000 r.p.m. for the stirrer blades. Ultrasonic transducer 27 can be operated to adjust its vibrational amplitude.

Therefore, the stirring device may be used to stir the liquid with the stirrer blades after adding the particles to the diluted binder solution and then to apply the ultrasonic vibration using the transducer 27, or the vibration may be applied while the liquid is being stirred. Or, the liquid may be stirred while adding the particles and applying the vibration. Stirring speed and the amplitude of vibration are adjustable, depending on the conditions of the particles, such as particle size and amount. Therefore, by using the stirrer to mix the solution coupled with applying ultrasonic vibration, ultra-fine particles which are prone to agglomerate can be dispersed uniformly in a liquid.

Figure 6:
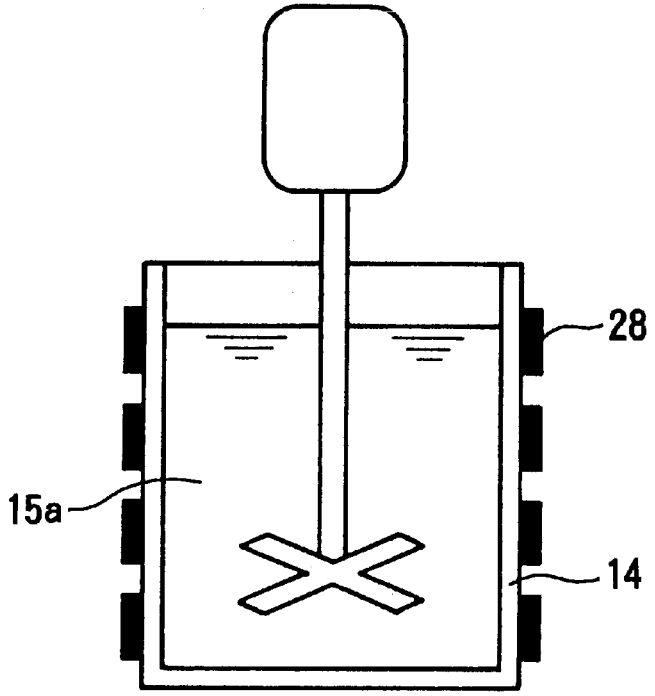
FIG. 6 shows a variation of the stirring device shown in FIG. 3.

FIG. 6 shows a case of placing a transducer 28 on the outer surface of the vessel 14. The transducer 28 transmits vibration to the liquid 15*a* through the wall of the vessel 14. The fine particles are dispersed uniformly in the liquid as in the case shown in FIG. 5.

Figure 7A:
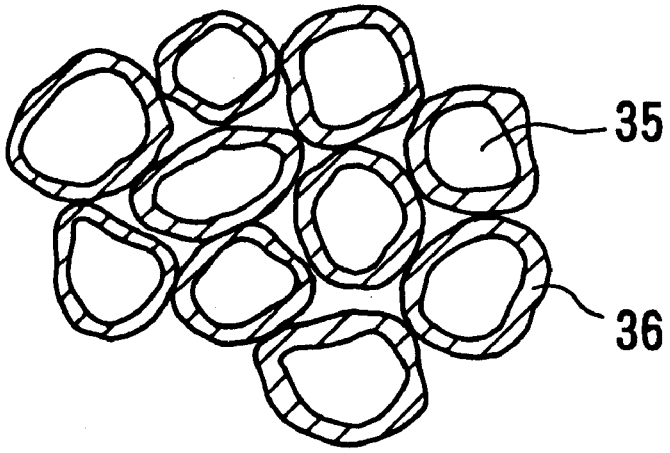
FIG. 7A is an illustration of microstructures of well dispersed coated particles.
Figure 7B:
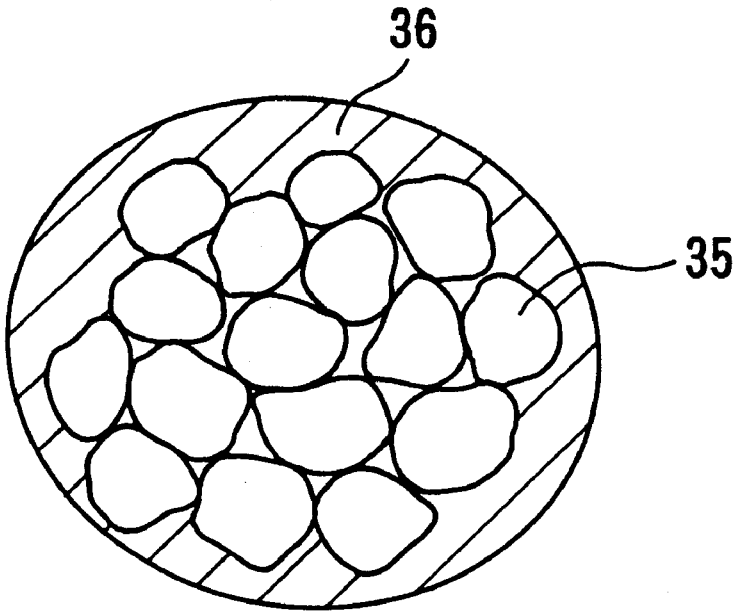
FIG. 7B is an illustration of microstructures of an agglomeration of particles which are not dispersed.

FIGS. 7A–7B show an examples of distribution of particles schematically, and FIG. 7A shows a good dispersion of the particles and FIG. 7B shows an agglomeration of particles which is caused by poor dispersion thereof. Silica particles 35 should be coated all around with a binder 36 such as phenol. As mentioned above, ultra-fine particles are extremely difficult to disperse uniformly in a liquid. If the particles are not sufficiently dispersed during the stirring process (FIG. 2C), the finished grinding plate contains clusters of many uncoated particles 35 shown in FIG. 7B. By carrying out the process of stirring using ultrasonic vibration, well dispersed particles 35 can be obtained to produce a structure shown in FIG. 7A.

Figure 8:
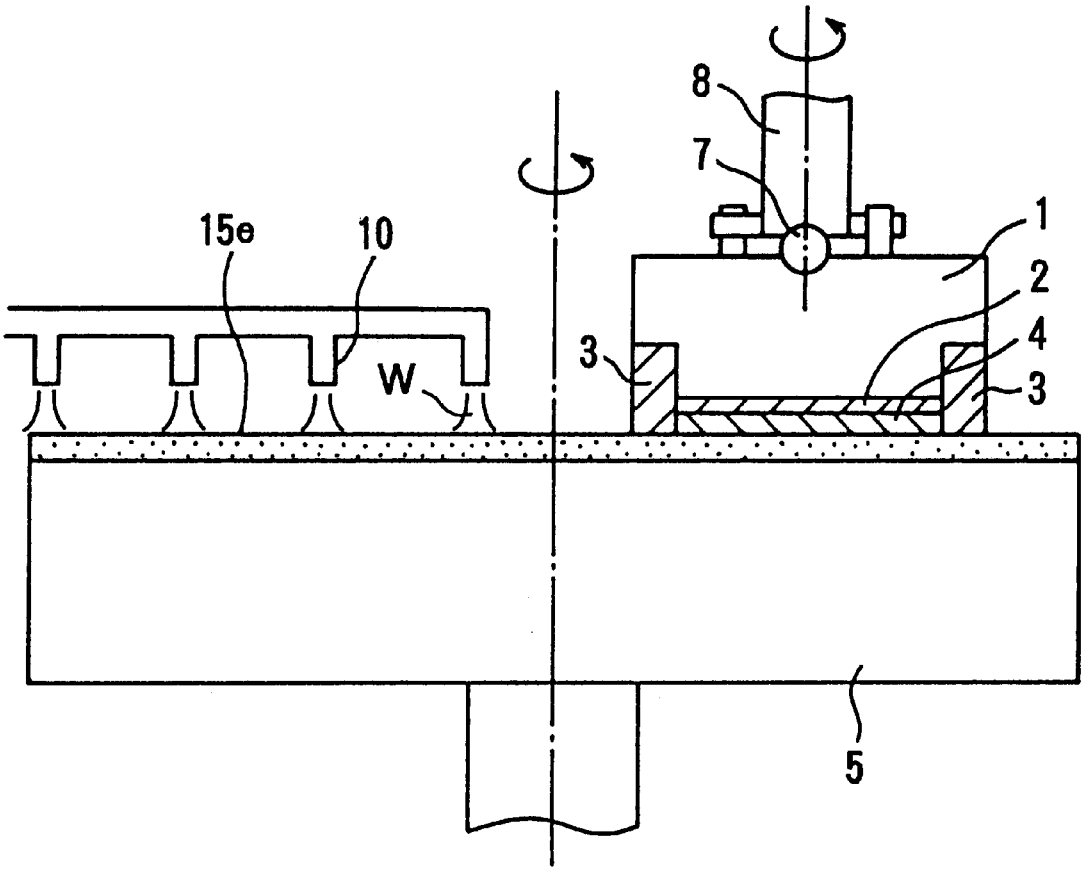
FIG. 8 is a side view of a polishing apparatus based on the grinding plate of the present invention.

FIG. 8 shows an example of the polishing apparatus using a grinding plate produced by the process presented above. The polishing apparatus is comprised by: a turntable 5 having a grinding plate 15*e* instead of a polishing cloth on its top surface; and water supply nozzles 10 for supplying water during polishing. Other parts are the same as the conventional polishing apparatus shown in FIG. 1. The purpose of supplying water on the abrasive surface of the grinding plate 15*e* is for lubricating and for cooling the interface by removing the heat generated by polishing.

The polishing apparatus performs polishing of a semiconductor wafer 4 held on the bottom surface of an elastic mat provided in a top ring 1 by pressing the wafer 4 onto the grinding plate 15*e* mounted on the turntable 1 while rotating both the turntable 5 and the top ring 1 so that the wafer 4 and the grinding plate 15*e* are subjected to a relative sliding motion. It is considered that the polishing action is produced by the fine particles, which had been bound to the grinding plate 15*e* but are now released from the grinding plate, abrading the wafer surface. By supplying water from the water supply nozzles, the interface between the wafer and the grinding plate is lubricated, and the heat generated by the polishing action is removed therefrom, thereby producing stable and uniform polishing. Instead of the water, an alkaline solution and other such chemical solution may be used.

According to the method of polishing thus presented, because the grinding plate is harder than the traditional polishing cloth, if surface undulations are formed on the wafer surface, the grinding plate can contact only the raised portions of the undulations, thereby providing precision polishing. Also, because polishing is performed without using a polishing solution containing a large quantity of fine particles, there is no need to use expensive polishing solution prepared for semiconductor polishing, so that the production cost can be lowered and the treatment of spent polishing solution becomes much easier and environmental concerns are reduced.

When there are clusters of poorly dispersed particles such as those shown in FIG. 7B and if such a grinding plate is used for polishing, there is a danger of producing scratch marks on the wafer corresponding to this location. In contrast, by using a grinding plate having a microstructure shown in FIG. 7A that exhibits a good dispersion of abrasive particles, a precision polished flat surface without generating scratches can be carried out consistently.

It should be noted that, in the embodiments presented above, phenol was used as the binder, but other binders such as polyimide, epoxy resins can be used equally effectively to produce the required dispersion. The size of the silica particles was 30 nm, but ultrasonic dispersion process can be applied to other particle sizes. Abrasive particles may include $CeO_2$, $Al_2O_3$, and diamond particles for producing the same effects. Various modifications can thus be made without departing from the basic requisite of the present invention, that the particles are well dispersed using ultrasonic vibration.

Such grinding plates are generally comprised of a structural body made of a resin binder to bind the abrasive particles and air bubbles constituting an aggregated void section. Abrasive particles may include fine powders of silica ($SiO_2$), silicon carbide (SiC), and celium oxide ($CeO_2$). The binder may include resins such as phenol, epoxy, and polyimide. An example of the composition of a grinding plate, in volume ratio (%), is:

particles:binder:bubbles=25:5:70.

Therefore, the proportion of the void section is relatively high.

For the processes using such grinding plates, a liquid such as water is generally supplied on the top surface of the grinding plate. The liquid serves the purpose of lubrication between the abrading surface and the object as well as the purpose of removing the heat generated by the sliding action, thereby facilitating the polishing process. However, because a large portion of the grinding plate is a void space, the whole structure acts like a sponge, and the liquid is absorbed into the pores.

Figure 9A:
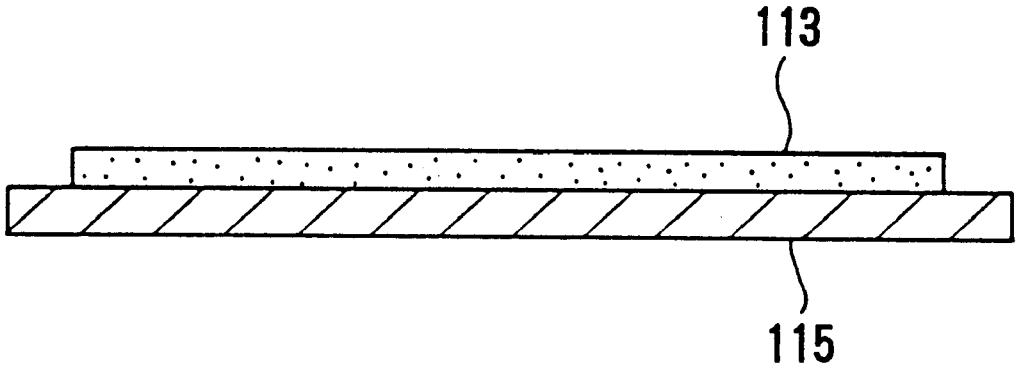
FIGS. 9A, 9B are illustrations, respectively, of a grinding plate in a dry state and the grinding plate in a wet state to show bowing of the abrasive surface generated in the a grinding plate.
Figure 9B:
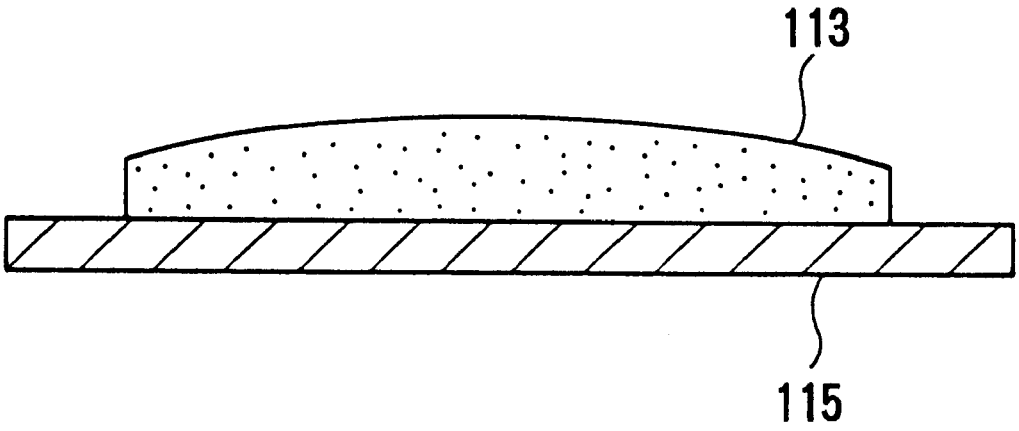

When absorption of liquid takes place in the interior of the grinding plate, the grinding plate will expand relative to the state of dryness. FIG. 9A shows a grinding plate 113 fixed to a base disk 115 in a dry state, producing a flat abrasive surface. However, during the polishing process, liquid is absorbed into the internal pores and the grinding plate expands. Because the bottom surface is fixed immovably to the base plate, the top surface is a free surface and deforms as illustrated in FIG. 9B. The center section of a wet circular grinding plate of 600 mm diameter can bow out to about 600 $\mu$m.

When such a bow is produced on the abrasive surface, obtaining a flat and mirror polished surface on the wafer becomes problematic.

A second embodiment will be presented with reference to FIGS. 10 to 13.

Figure 10A:
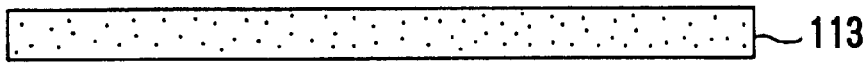
FIGS. 10A~10E are illustrations of steps of manufacturing a grinding plate.

FIGS. 10A–10E show the manufacturing steps for this embodiment of the grinding plate. First, as shown in FIG. 10A, a grinding plate 113 is produced in a dry state. An example of the process for making such a grinding plate is described in the following. First, polishing particles such as silica are dispersed by stirring them in an organic liquid made by diluting a binder substance such as phenol in an organic solvent to produce a precursor liquid suspension to bind the particles to the binder material. The liquid binder envelops the particles in the liquid suspension. The liquid suspension is heated and dried to vaporize the organic solvent. This process produces a solid intermediate body having the phenol binder melt-bonded to the abrasive particles. This intermediate body is heated, dried and pulverized to produce an intermediate material in a powder form. Then, the powdered intermediate material is poured into a mold, and is press-molded under heat to produce a grinding plate. This grinding plate is comprised by a mechanically strong solid structure having the abrasive particles firmly bound to the phenol binder. In the process of press-molding, air becomes occluded in the grinding plate structure to produce bubbles.

Figure 10B:
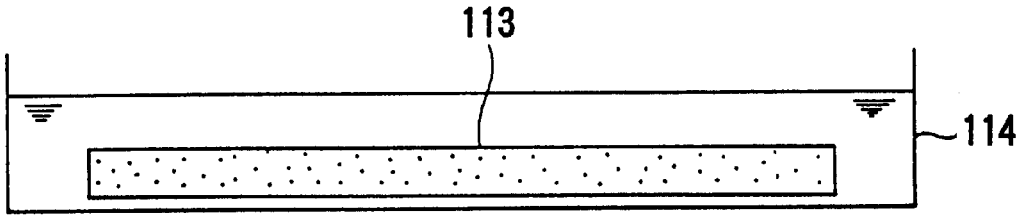
Figure 10C:
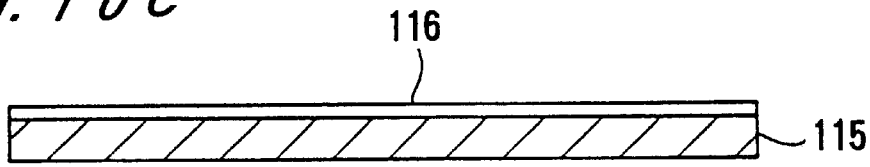

Next, as shown in FIG. 10B, the grinding plate in a dry state is immersed in water held in a container 114 so that the grinding plate reaches a water-infiltrated state in about 30 minutes. Next, as shown in FIG. 10C, a base disk 115, made of a stainless steel or aluminum plate, is coated with an aqueous adhesive 116. The adhesive may include "aqua-bond" made by Konica (commercial brand) or a water hardening bonding material No. 2083 made by Three Bond. Such bonding agent will bond the grinding plate securely to the base plate.

Figure 10D:
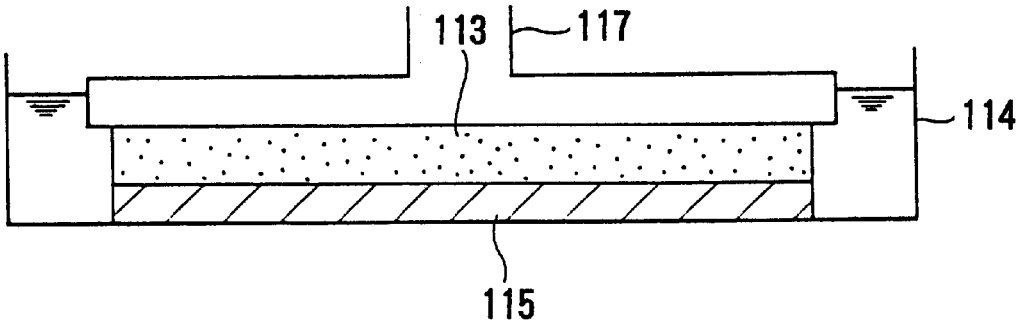
Figure 10E:
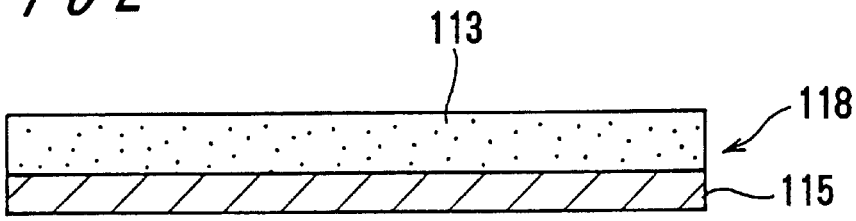

FIG. 10D illustrates a base disk 115 coated with a bonding agent being pressed by a pressing device 117, a weight to keep the assembly at the bottom of the container 114 and under the water. Complete hardening takes place in the water within about 5~6 hours at 20~25° C. to securely bond the grinding plate to the base disk in the water. Next, the polishing tool 118 comprised by a base disk 115 bonded to the grinding plate 113 is taken out of the water to produce a water-infiltrated grinding plate 118.

In bonding the grinding plate to the base plate in water, it is important to maintain the water temperature at about 20~25° C. by using a constant temperature bath device to keep the grinding plate in the temperature range expected to be used. By so doing, when the grinding plate is actually used for polishing, it reaches the same temperature as the manufacturing temperature, and deformation caused by differential thermal effects can be prevented.

Figure 11:
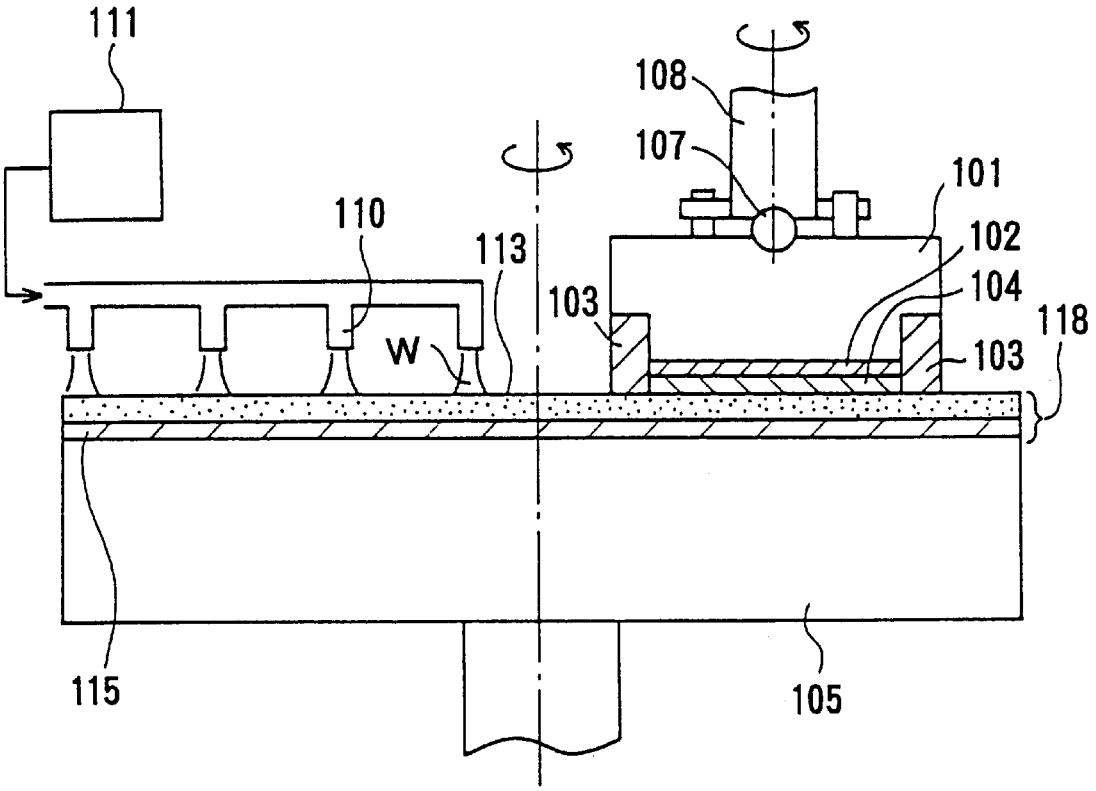
FIG. 11 is a schematic diagram of the essential parts of the polishing apparatus of the present invention.

FIG. 11 shows an example of a polishing apparatus using a grinding plate made by this process. The polishing apparatus is comprised by: a turntable 105 having a polishing tool 118 comprised by a water-infiltrated grinding plate 113 bonded to a base disk 115; and a water supply nozzle 110 to supply water during polishing. Other details of the construction are the same as those in the apparatus shown in FIG. 1. Water serves the purpose of lubricating the interface of the grinding plate 113 and removal of heat generated during polishing. An alkaline solution may also be used instead of water.

The polishing tool 118 can be detached from the apparatus by unfastening attachment devices, such as screws, from the turntable 105. The grinding plate 113 can maintain the state of water-infiltration in a special holding container which will be described later. The grinding plate 113 should be removed from the container just before its use, and returned after use to the holding container.

This apparatus is operated as follows. A wafer 104 is held on the bottom surface of an elastic mat 102 disposed on the bottom surface of the top ring 101, and is pressed against the grinding plate 113 mounted on top of the turntable 105. Turntable 105 and the top ring 101 are rotated independently to produce a relative sliding motion between the wafer 104 and the grinding plate 113. It is thought that surface material removal is performed by the polishing action of the detached particles freed from the bonded grinding plate structure. By supplying water W from the nozzle 110, the interface between the grinding plate and the wafer is lubricated, and the heat generated by polishing is removed. The process produces stable and uniform polishing.

The pores in this grinding plate 113 in this embodiment are sufficiently pre-filled with water. The conventional dry grinding plate could not provide lubrication and cooling at the beginning of a polishing process because the initial supply of water is absorbed into the pores in the dry grinding plate. The present grinding plate 113 is able to be used from the start to the end of polishing, by supplying providing water at a steady rate for stable lubrication and cooling.

According to the polishing method using such a grinding plate, because the grinding plate is stiffer than cloth, only the raised portions of the surface are removed by contacting with the abrasive surface, thereby producing a precision polished surface. Also, because it is not necessary to use a large amount of abrasive particles, there is no need for using expensive slurry solutions prepared for semiconductor polishing purposes, thereby lowering the cost of the polishing operation, and also facilitating the handling of spent solution. The environmental concern is also significantly reduced.

The apparatus shown in FIG. 11 uses a grinding plate, instead of a slurry, with a turntable, but other types of polishing apparatus can also be used. Such types include scroll type or cup type.

The scroll type polishing is based on holding the wafer in a holding device and a grinding plate fixed to a base disk, and the two parts are scrolled in circulatory translational motions relative to each other. The cup type polishing is based on a cup-shaped grinding wheel held in a holding device and the wafer is firmly attached to the base plate. The two parts are pressed together and caused to slide to produce a polishing action. In these apparatuses, the grinding plate is pre-infiltrated with water and is then fixed to the base member, and the grinding plate is maintained in a wet condition, thus preventing bowing produced by a cycle of wetting and drying.

Figure 12:
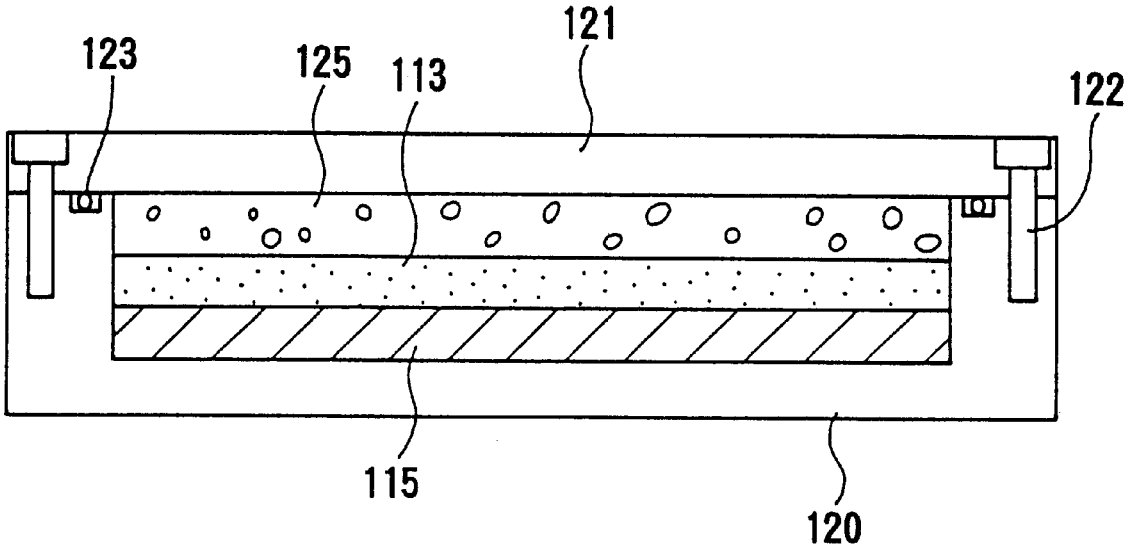
FIG. 12 is a schematic diagram of a container of a polishing tool of the present invention.

FIG. 12 shows a container for holding or transporting a grinding plate in a water-infiltrated condition. A case 120 made of a polymer holds a grinding plate 113 in a water-infiltrated condition mounted on a base disk 115. A sponge 125 holding a lot of water is placed on top of the grinding plate 113. A lid 121 is placed on top and is bolted to the case 120, thereby sealing the grinding plate 113 inside with the sponge 125. An O-ring 123 seals the case 120 and the lid 121. The sponge may be replaced with water. In this case, the lid should be made of a light material to decrease the weight of the case 120 for transportation.

Figure 13:
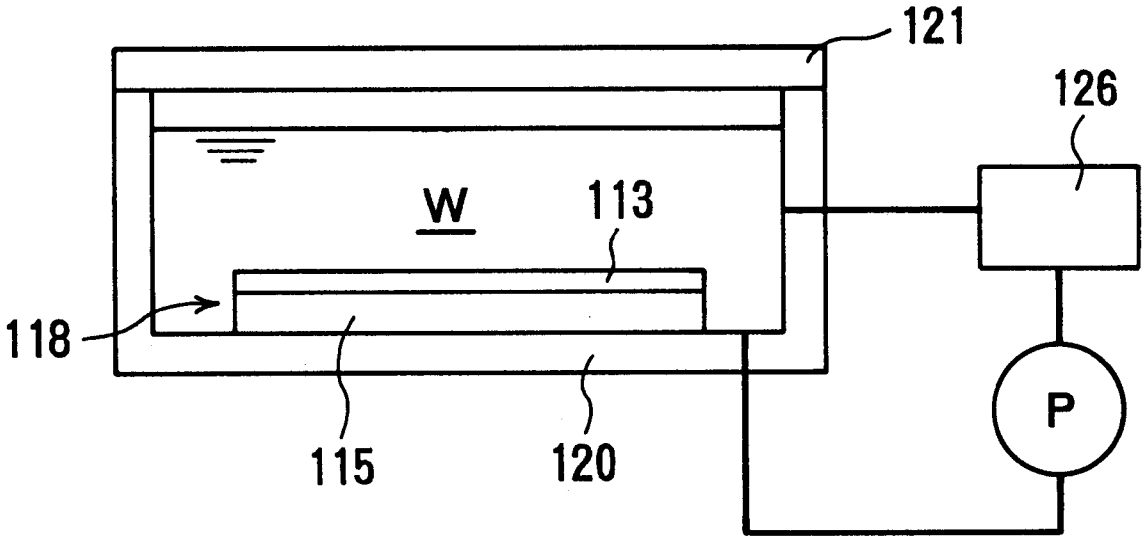
FIG. 13 is a variation of the container of the polishing tool of the present invention.

The grinding plate in the wet condition should preferably be stored so that its temperature coincides with the temperature of use, for example 20~25° C. By so doing, it is possible to maintain the grinding plate constantly at a certain temperature to prevent deformation of the grinding plate caused by differential thermal deformation effects. The method of keeping the grinding plate at a constant temperature may include storing the polishing tool 118 inside water, as shown in FIG. 13, and circulating the water using a pump P through a constant temperature bath 126. It is also permissible to store the tool in the container shown in FIG. 12 made of a thermally insulating material.

Further, it is preferable that storage of the tool in water or in a wet condition be carried out in water having a bacterial control. The storage water should contain an organic solvent such as methanol, ethanol or acetone, or other anti-bacterial agent. The difference in the microbial growth is illustrated in the following comparison. When the grinding plate is immersed in plain water, after one month of storage, ATP reaction indicating the growth of micro-organisms indicated a fluorescence value of 153 RLU. On the other hand, a grinding plate stored in water containing 10% ethanol shows a fluorescence value of 16 RLU. These results indicated that liquid with added ethanol significantly prevented the growth of micro-organisms.

The methods of storage illustrated in FIGS. 12, 13 are examples, and other methods, such as a sealable bag storing the tool with water can be used.

Therefore, after completing polishing using the grinding plate, the grinding plate may be stored in such a container, and the grinding plate can be maintained always in a wet condition. Such a storage method for the tool 118 offers an advantage that it is portable.

When the time interval between the end of polishing and starting another polishing operation is relatively short, it is not always necessary to store the tool in a storage container because water vaporization is relatively slow.

As explained above, by attaching the grinding plate to a support base in a wet condition, drying and wetting cycles associated with the polishing process can be avoided, thereby preventing surface quality problems caused by bowing of the abrasive surface.

Figure 14A:
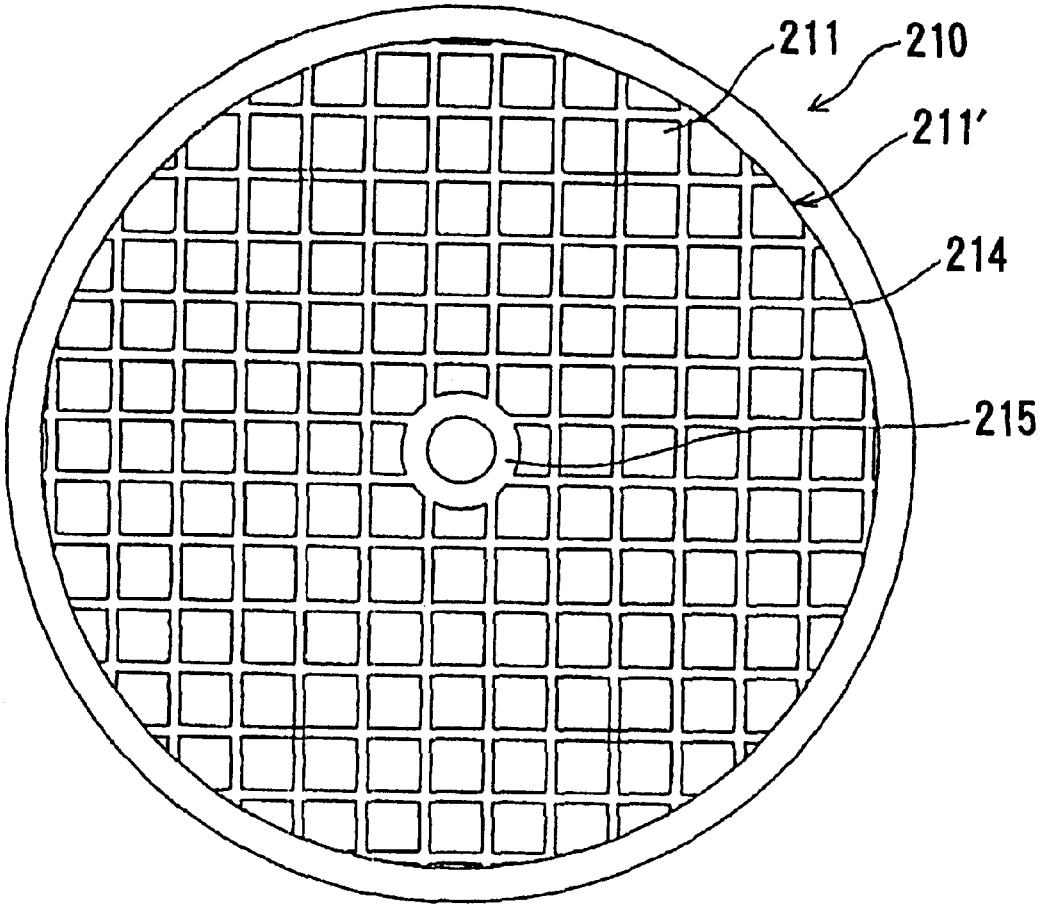
FIGS. 14A, 14B are, respectively, a plan view and a cross sectional view of the polishing tool.
Figure 14B:
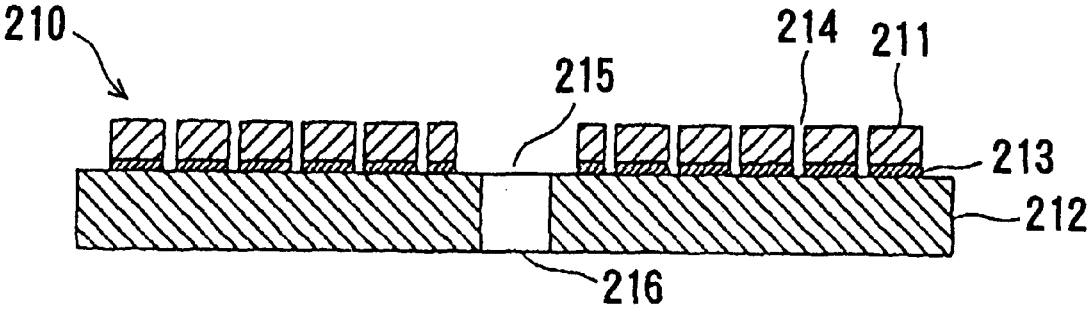

A third embodiment will be presented with reference to FIGS. 14A to 25B. FIG. 14A shows a plan view and FIG. 14B shows a cross sectional view of an embodiment of a grinding plate 210. The grinding plate 210 is comprised by a base disk 212 having a flat bonding surface for attaching a grinding plate base 211' with an adhesive 213 while on top of the grinding plate base 211', a series of latticed grooves 214 are fabricated to a depth to reach the adhesive surface on the base disk 212, thereby dividing the grinding plate base 211' into a plurality of segmented grinding plate pieces 211 so that the segmented grinding plate pieces 211 form latticed grooves 214, and a hole 215 of a given size is provided in the center section. A hole 216 is also provided in the center section of the base disk 212.

Figure 15A:
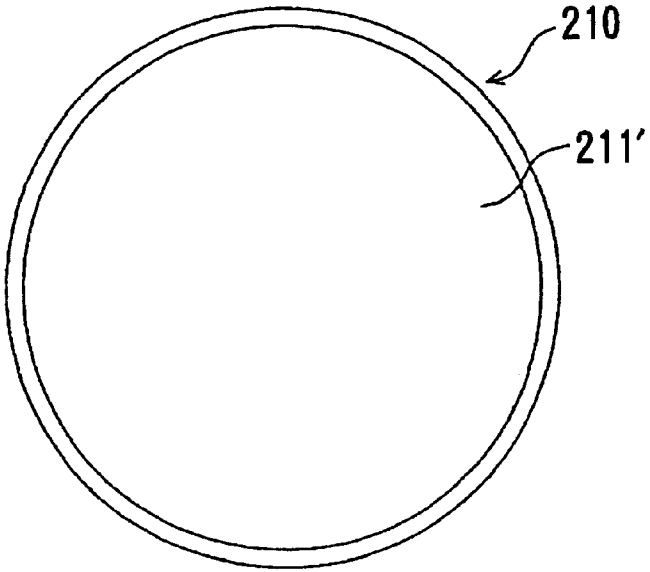
FIGS. 15A~15D are, respectively, a plan view, a cross sectional view of an in-process grinding plate, and a plan view and a cross section view of the completed grinding plate.
Figure 15B:
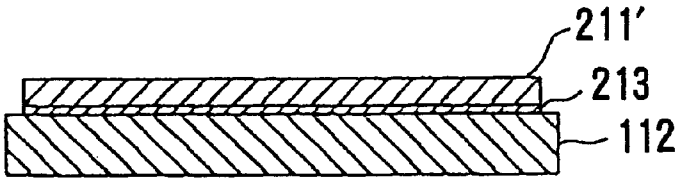
Figure 15C:
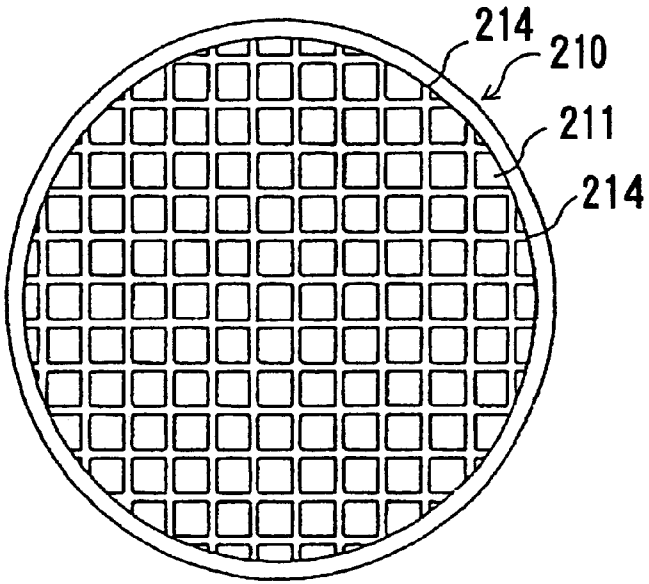
Figure 15D:
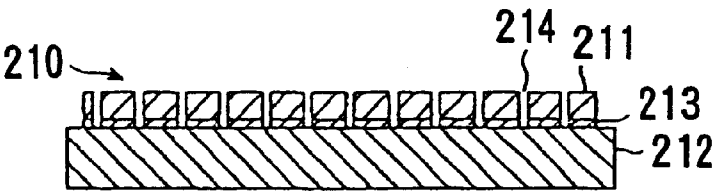

FIGS. 15A–15D show the manufacturing steps for making such a grinding plate 210. FIG. 15A is a plan view of an in-process grinding plate; FIG. 15B is its cross sectional view; and FIG. 15C is a plan view of a completed grinding plate; and FIG. 15D is its cross sectional view.

As shown in FIGS. 15A, 15B, a circular grinding plate base 211' and a circular base 212 are readied for making the grinding plate 210, by bonding the grinding plate base 211' on the top surface of the base 212 using a bonding agent 213. When the bonding agent 213 is dry and the grinding plate base 211' becomes firmly fixed on the top surface of the base 212, a series of latticed grooves 214 are fabricated on the top surface of the grinding plate base 211' so as to form a plurality of rectangular shaped grinding plate pieces 211. By so doing, as shown in FIGS. 15C, 15D, segmented grinding plate pieces 211 fixed to the base 212 are formed while forming spaces between the grinding plate pieces 211 to serve as latticed grooves 214. This design of the grinding plate pieces 211 also prevents bowing of the surface of the grinding plate 210 caused by stresses generated between the bonding agent 213 and the base 212 due to wet/drying cycles, or by dispersing the thermal stresses uniformly over the grinding plate 210.

Grinding plate base 211' is made by mixing abrasive particles and binders, and by press-sintering in a hot press. Abrasive particles include $CeO_2$, $SiO_2$, $Al_2O_3$, $ZrO_2$, $MnO_2$, and $MnO_3$ particles of less than 2 $\mu$m diameter, and binders include polyimide, phenol, urethane, polyvinyl alcohol (PVA) resins. The adhesive agent 213 is a resin adhesive such as epoxy resin, and the base material is a metal such as aluminum. In this example, the grinding plate base 211' has a shape of 5 mm thickness by 600 mm diameter, and the latticed grooves 214 each have a width of 2 mm and are spaced apart at 20–100 mm. These parameters may be varied depending on the application.

Figure 16:
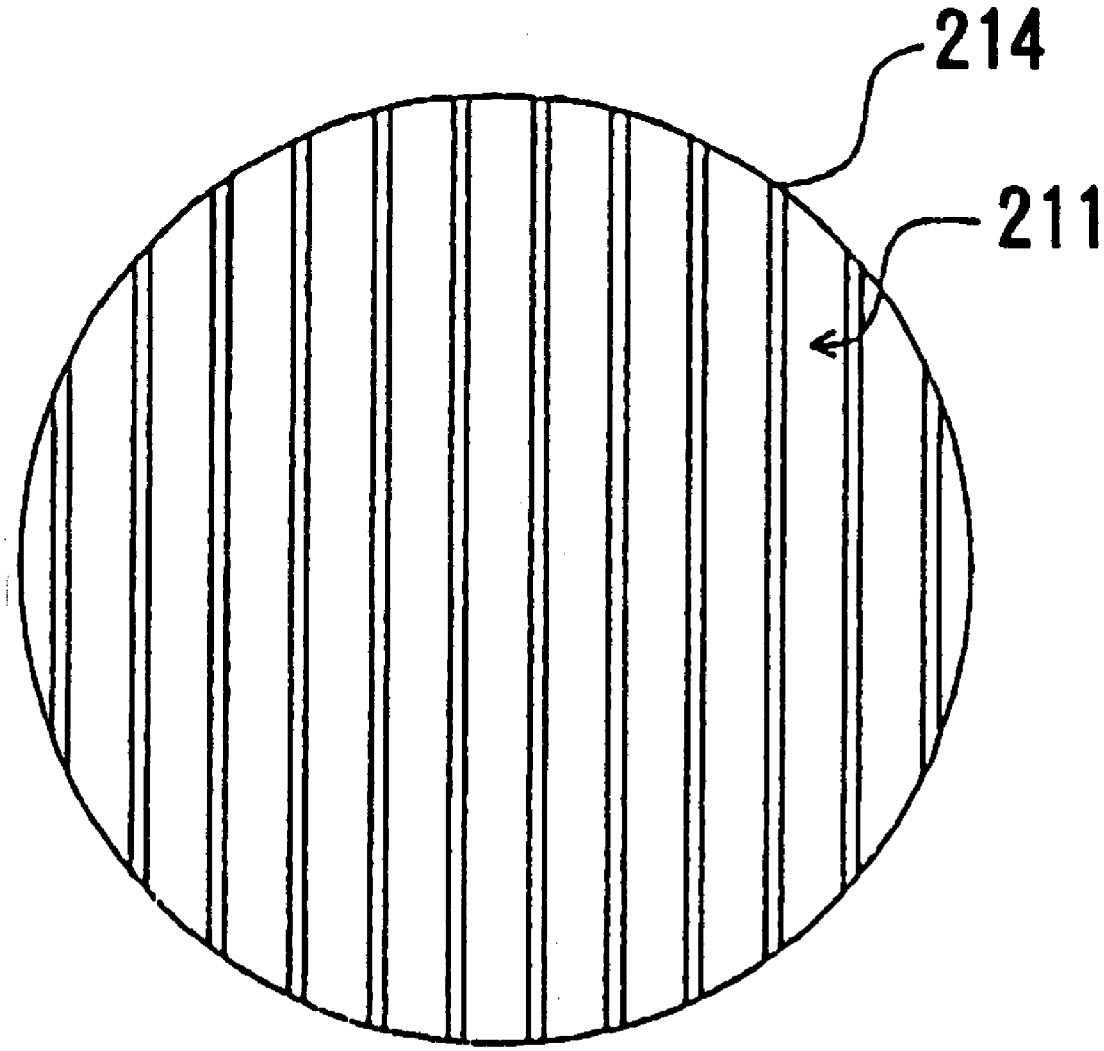
FIG. 16 is a plan view of cutting grooves of the polishing tool.
Figure 17:
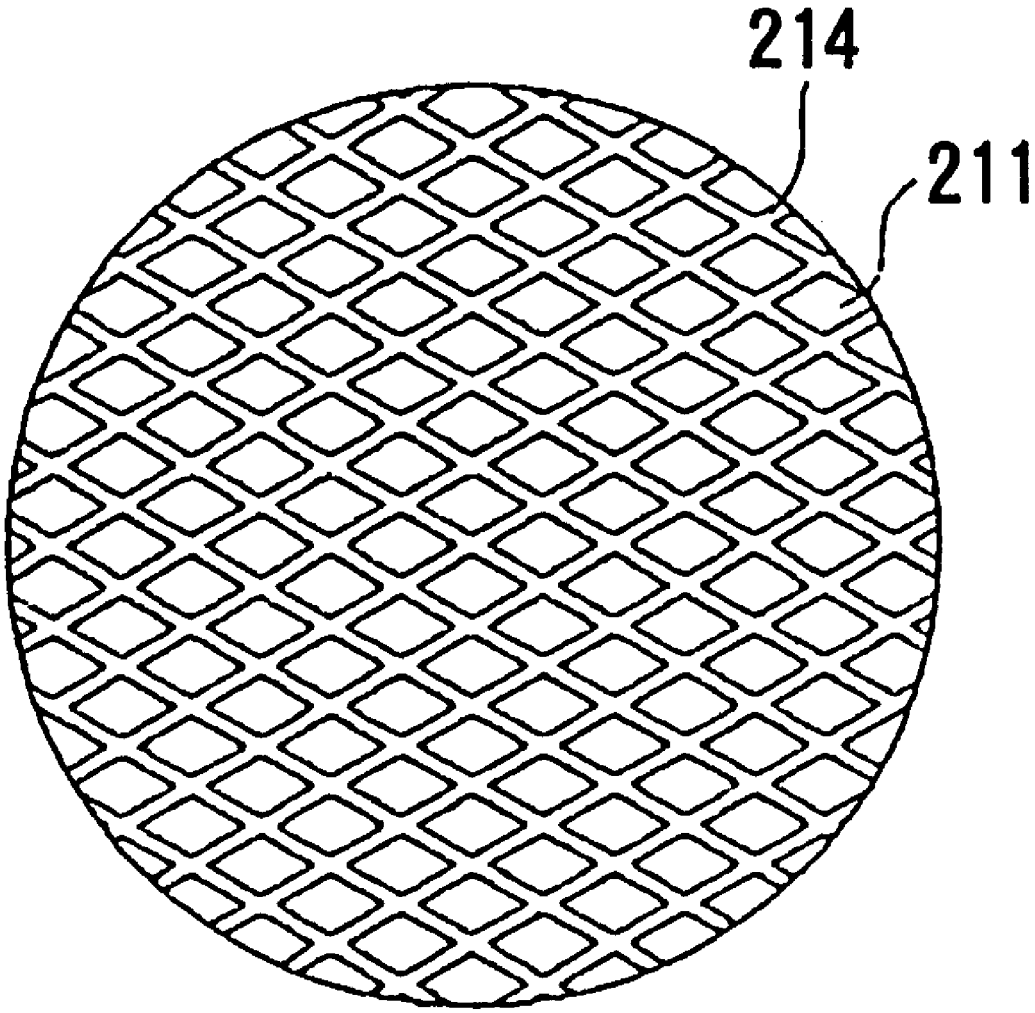
FIG. 17 is a plan view of other cutting grooves of the polishing tool.
Figure 18:
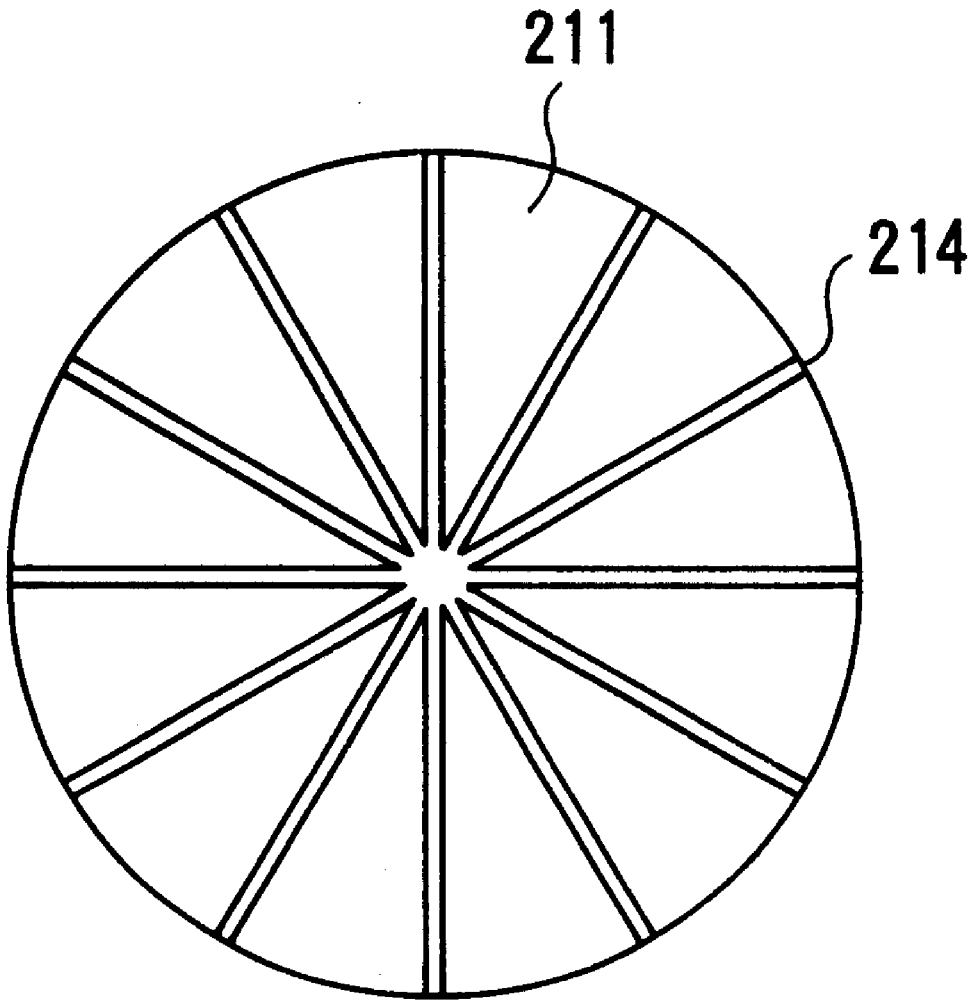
FIG. 18 is a plan view of yet other cutting grooves of the polishing tool.

The shape of the cutting grooves is not limited to the one shown in FIG. 15C, and may be parallel cutting grooves 214 such as shown in FIG. 16, or a diamond latticed structure 214 such as shown in FIG. 17, or a sector structure such as shown in FIG. 18. The important point is that the shape of the grooves should be such as to uniformly disperse the stresses in the interface between the base 212 and the adhesive 213 caused by wetting/drying cycles or thermal stresses.

Figure 19:
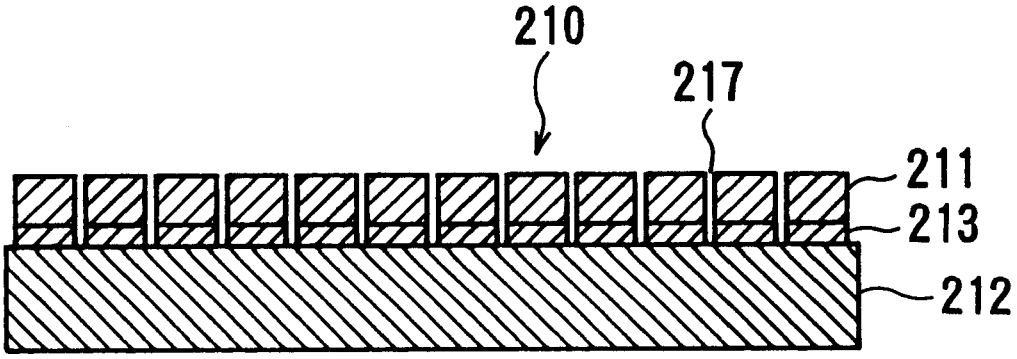
FIG. 19 is a cross sectional view of cutting grooves of the polishing tool.

FIG. 19 shows a cross sectional view of a grinding plate of the present invention. This grinding plate 210 is comprised by a base disk 212 and a plurality of grinding plate pieces 211 which are individually fixed to the bonding surface of the base 212 leaving a given spacing 217 therebetween. The compositions of the grinding plate pieces 211 and the adhesive agent 213 are approximately the same as the segmented grinding plate pieces 211 shown in FIGS. 14A–15D, and the spacing 217 between the grinding plate pieces is about the same as the width of the grooves 214 shown in FIGS. 14A–14B. The segmented cutting structure exhibits the same polishing behavior as the grinding plate shown in FIGS. 14A–14B. The shape of the segmented grinding plate pieces 211 is not limited to a rectangular shape so long as the structure obtained by bonding the grinding plate pieces 211 using an adhesive agent 213 on the base disk 212 with spacing 217 exhibits the property to disperse the stresses generated uniformly through the structure so that the abrasive surface does not show bowing during use.

Figure 20:
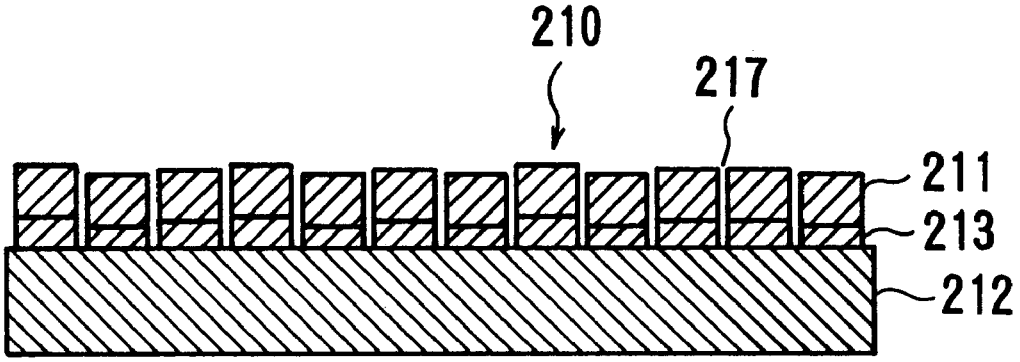
FIG. 20 is a cross sectional view of cutting grooves of the polishing tool.

In the case presented above, if the segmented grinding plate pieces 211 are fixed individually to the base disk 212 using an adhesive 213 as shown in FIG. 19, because the thickness of the individual pieces can vary and the thickness of the adhesive layer may not be uniform for all the segmented grinding plate pieces 211, the top surfaces of the grinding plate pieces 211 may not become coplanar. This is illustrated in FIG. 20.

Figures 21A, 21B, 21C:
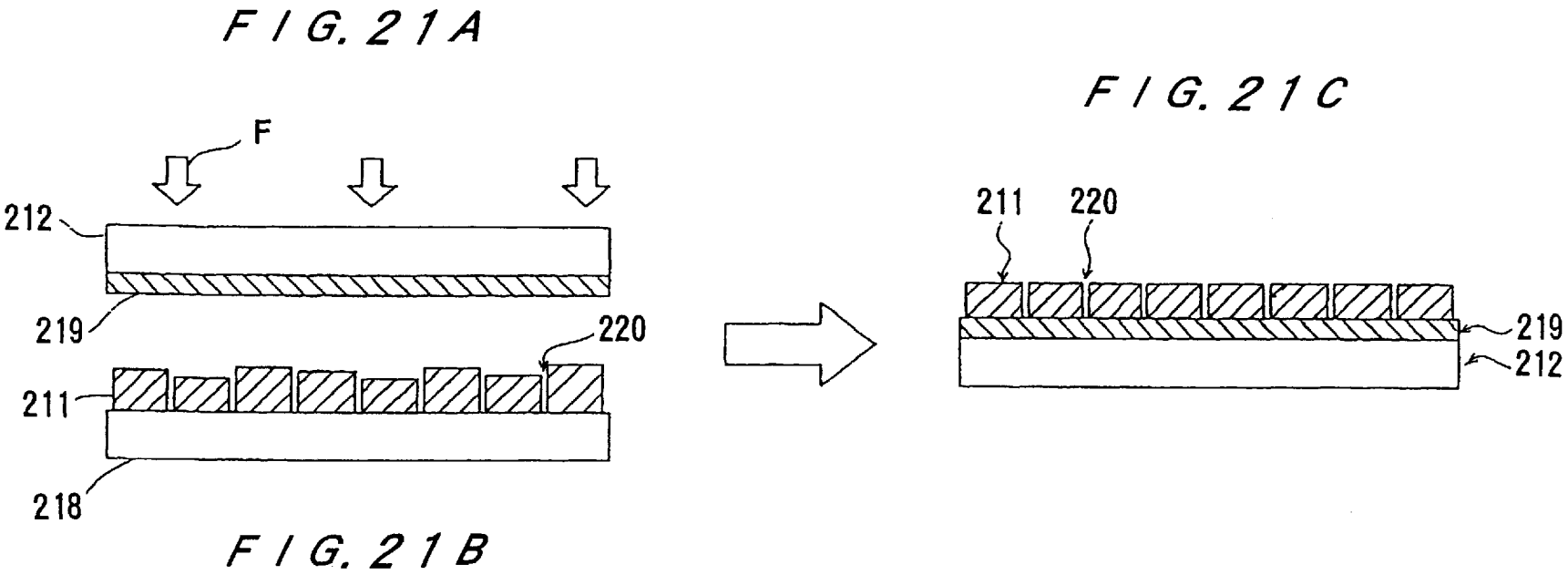
FIGS. 21A~21C are illustrations of steps of manufacturing a grinding plate.

A method of making a grinding plate resolves this problem. FIGS. 21*a*–21C show the various steps involved in this method. As shown in FIGS. 21A, 21B, a base disk 212 and a flat plate 218 are prepared, and either a thermo-melting bonding strip (nylon sheet, for example that can melt at about 100° C.) is attached to or an adhesive agent 219 is coated on the bonding surface of the base section 212, and in the meantime, a plurality of segmented grinding plate pieces 211 are placed on top of the flat plate 218 with a given spacing 220 between the grinding plate pieces 211.

The adhesive strip or the adhesive agent 219 on the bonding surface of the base disk 212 is heated, and as shown by the arrow F in FIG. 21A, a force is applied on the base disk 212 so as to press the plurality of grinding plate pieces 211 placed on the flat plate 218 into the adhesive layer. The result is that the grinding plate pieces 211, having top surfaces of aligned coplanarly on the flat plate 218, are fixed to the base disk 212, thereby aligning the abrasive surfaces of the grinding plate pieces 211 and allowing the stresses generated to be uniformly dispersed to prevent bowing of the abrasive surface. In this case also, the shape of the grinding plate pieces 211 need not be limited to a rectangular shape. The important point is that the grinding plate pieces 211 are bonded with a sheet or adhesive 219 with spacing 220 so as to uniformly disperse any generated stresses to prevent bowing of the abrasive surface.

Figure 22A:
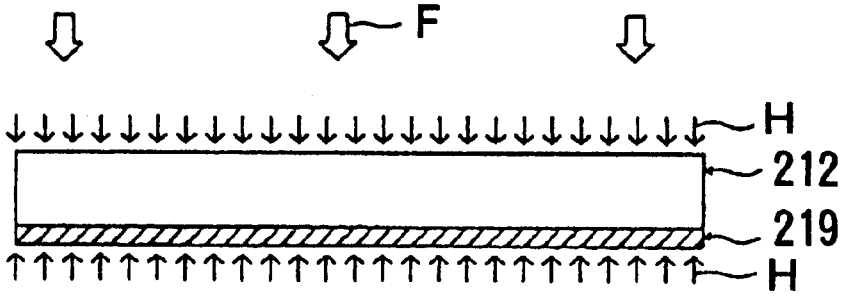
FIGS. 22A~22B are illustrations of steps of manufacturing a grinding plate.
Figure 22B:
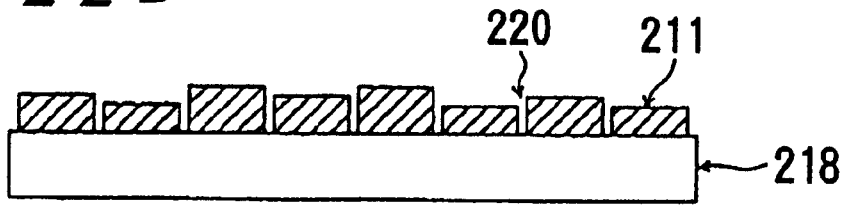
Figure 23A:
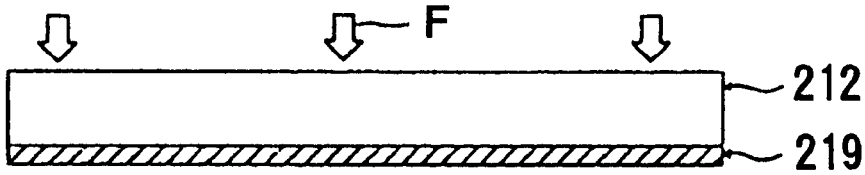
FIGS. 23A~23B are illustrations of steps of manufacturing steps for the grinding plate.
Figure 23B:
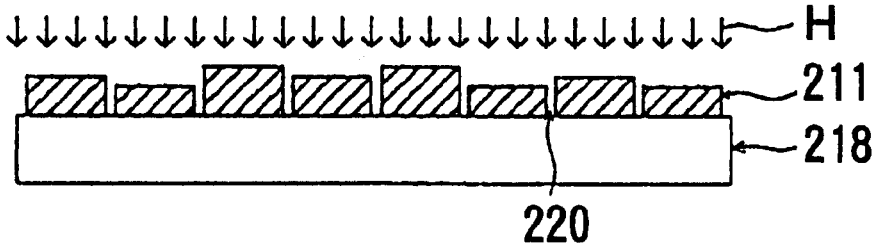

FIGS. 22*a*–23B illustrate the steps of making a grinding plate. As shown in FIG. 22A, hot melting strip or adhesive 219 and the back surface of the base disk 212, or one of the two surfaces, are heated, and as shown by the arrow F, a force is applied on the base disk 212, as shown in FIG. 22B, to press on a plurality of grinding plate pieces 211 placed on a flat plate 218 to produce a grinding plate shown in FIG. 21C. Or, the bonding surface of the grinding plate pieces 211 placed on the flat plate 218 may be heated, as shown in FIG. 23B, so as to press the hot melt strip or adhesive 219 to the heated bonding surfaces of the grinding plate pieces 211 to produce the grinding plate shown in FIG. 21C.

In the examples presented above in FIGS. 20 to 23B, the compositions of the grinding plate pieces 211 and the adhesive agent 219 are the same as those for the grinding plate pieces 211 shown in FIGS. 14*a*–14B. The material for the base disk 212 is also the same as that shown in FIGS. 14*a*–14B.

Figure 24:
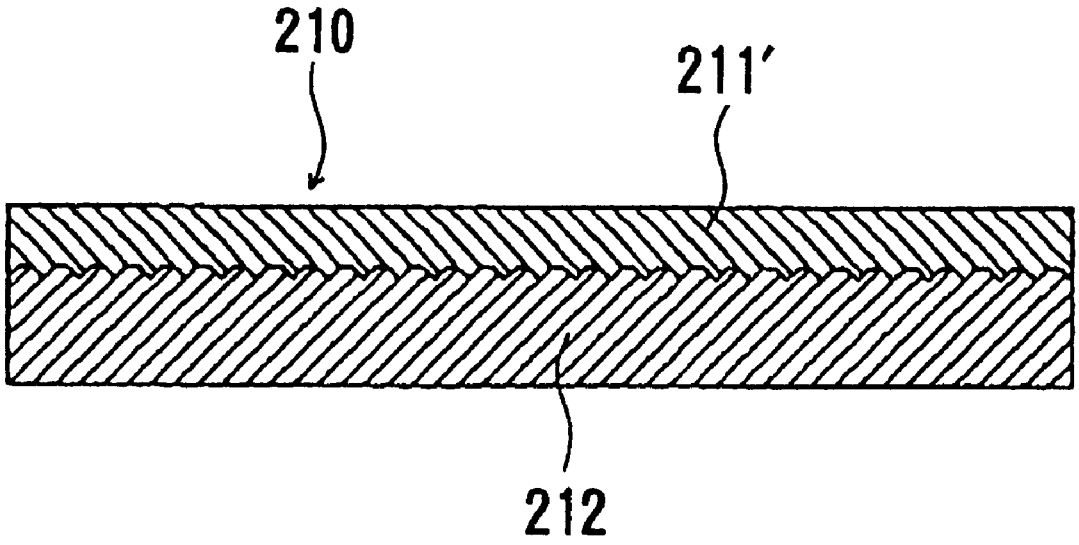
FIG. 24 is a cross sectional view of a grinding plate.

FIG. 24 shows a cross sectional view of a grinding plate 210. The grinding plate 210 is made by surface treating, such as sandblasting, the bonding surface of the base disk 212 to a roughness of less than 1 mm prior to bonding, and a grinding plate base 211' is bonded at the same time as press-sintering. Abrasive powder used in this case is $CeO_2$ and the adhesive agent is polyimide or phenol. The base disk 212 is made of aluminum. When phenol is used for the base, the thermal expansion coefficient of phenol, which is $25\sim27\times10^{-6}$, is very close to that of aluminum and therefore, there is almost no bowing of the abrasive surface.

The particles and adhesive used in the above case are only examples, and need not be limited to such materials. Especially, when the values of the coefficient of thermal expansion are nearly identical or very close, there is almost no bowing of the abrasive surface of the grinding plate 210.

Figure 25A:
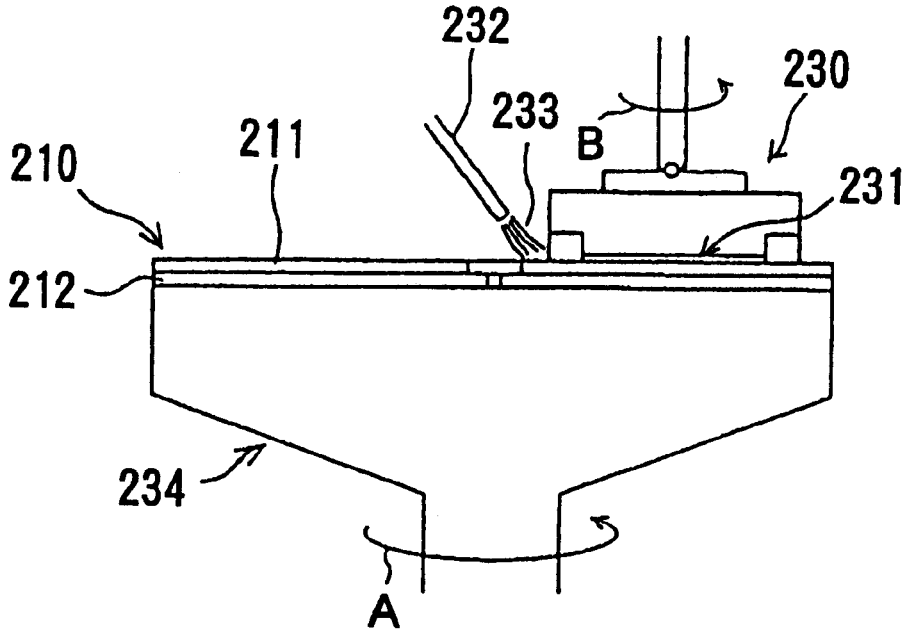
FIGS. 25A, 25B are, respectively, a cross sectional view and a plan view of a polishing apparatus.
Figure 25B:
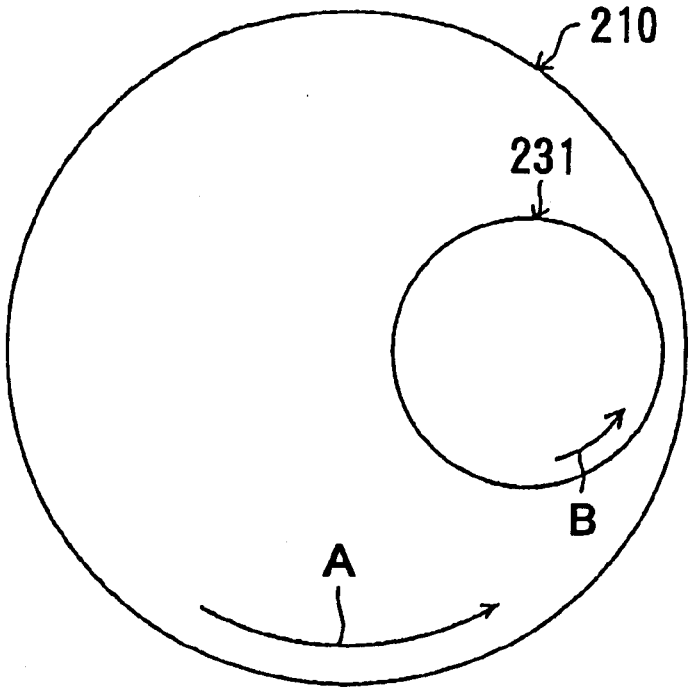

FIGS. 25A–25B show a schematic diagrams of the polishing apparatus based on the grinding plate of the present invention. FIG. 25A is a cross sectional view of the apparatus and FIG. 25B is a plan view showing the directions of rotation of the grinding plate 210 and the wafer. A grinding plate 210 is attached to the top surface of a turntable 234. The grinding plate may be the segmented plate pieces 211 or a solid type shown in FIG. 24. The object 231 to be polished such as a wafer is held in the bottom surface of the top ring 230. Also, water is supplied from a pipe 232 on the top surface of the grinding plate pieces 211 in the grinding plate 210.

The operation of the apparatus is as follows. Turntable 234 is rotated in the direction of the arrow A, and the top ring 230 is rotated in the direction of the arrow B, and water 233 is supplied from the pipe 232 during polishing. Although not shown in the drawing, the object 231 is uniformly polished by the layer of abrasive particles formed on the top layer of grinding plate pieces 211. Because the grinding plate is comprised by segmented grinding plate pieces 211, there is no bowing of the abrasive surface and the surface of the object 231 is polished uniformly to produce a precision polished product.

In the example presented above, the grinding plate 210 and the top ring 230 are both made to undergo rotational movements to produce a polishing action, but it is not necessary to limit to this method. The important consideration is that polishing is performed by mutual motion of both the grinding plate and the top ring.

Although certain preferred embodiments of the present invention have been shown and described in detail, it should be understood that various changes and modifications may be made thereto without departing from the scope of the appended claims.

What is claimed is:

1. A polishing apparatus to polish to a flat and mirror finish a surface of an object to be polished by pressing and sliding the surface of the object on an abrasive surface, said apparatus comprising:

a polishing tool detachably mountable in said apparatus, said tool providing said abrasive surface, said polishing tool comprising abrasive particles and a binder binding said abrasive particles;

a top ring to hold the object to be polished;

a pressing and sliding device to produce, while the object is being held by said top ring and when said tool is mounted in said apparatus, a relative sliding motion between the surface of the object and said abrasive surface and to press the surface of the object against said abrasive surface; and said tool being in a wetted condition before being mounted in said apparatus.

2. An apparatus as claimed in claim 1, wherein said tool, after being mounted in said apparatus, is wetted by water or chemical solution.

3. An apparatus as claimed in claim 1, wherein said tool comprises a grinding plate formed of said abrasive particles and said binder, and a base section to support said grinding plate.

4. An apparatus as claimed in claim 3, wherein said grinding plate is in a water-infiltrated condition before being mounted in said apparatus.

5. An apparatus as claimed in claim 3, wherein said grinding plate is fixed to said base section by an aqueous adhesive.

6. An apparatus as claimed in claim 3, wherein said grinding plate has a water-infiltrated construction resulting from immersing said grinding plate in water, the thus resulting water-infiltrated grinding plate being fixed to said base section.

7. An apparatus as claimed in claim 6, wherein said grinding plate has a construction resulting from maintaining said water within a temperature range to which said grinding plate is expected to be subjected during polishing.

8. An apparatus as claimed in claim 1, further comprising a container having a construction to maintain said tool in a water-infiltrated condition after detaching of said tool from said apparatus.

9. An apparatus as claimed in claim 1, further comprising a portable storage container having a construction to maintain said tool, when not mounted in said apparatus, under water or in a moistened condition.

10. An apparatus as claimed in claim 9, further comprising an anti-microbial substance added to said container.

11. An apparatus as claimed in claim 10, wherein said anti-microbial substance comprises ethanol.

12. An apparatus as claimed in claim 9, wherein said tool is stored in said container at a controlled predetermined temperature range.

13. An apparatus as claimed in claim 9, wherein said container has a cover for liquid tight sealing and opening and closing of said container.

14. A polishing apparatus to polish to a flat and mirror finish a surface of an object to be polished by pressing and sliding the surface of the object on an abrasive surface, said apparatus comprising:

a polishing tool detachably mountable in said apparatus, said tool providing said abrasive surface, said polishing tool comprising abrasive particles and a binder binding said abrasive particles;

a top ring to hold the object to be polished;

a pressing and sliding device to produce, while the object is being held by said top ring and when said tool is mounted in said apparatus, a relative sliding motion between the surface of the object and said abrasive surface and to press the surface of the object against said abrasive surface; and said tool being maintained in a moistened condition when polishing is not being conducted by said apparatus.

15. An apparatus as claimed in claim 14, wherein said tool, after being mounted in said apparatus, is wetted by water or chemical solution.

16. An apparatus as claimed in claim 14, wherein said tool comprises a grinding plate formed of said abrasive particles and said binder, and a base section to support said grinding plate.

17. An apparatus as claimed in claim 16, wherein said grinding plate is in a water-infiltrated condition before being mounted in said apparatus.

18. An apparatus as claimed in claim 16, wherein said grinding plate is fixed to said base section by an aqueous adhesive.

19. An apparatus as claimed in claim 16, wherein said grinding plate has a water-infiltrated construction resulting from immersing said grinding plate in water, the thus resulting water-infiltrated grinding plate being fixed to said base section.

20. An apparatus as claimed in claim 19, wherein said grinding plate has a construction resulting from maintaining said water within a temperature range to which said grinding plate is expected to be subjected during polishing.

21. An apparatus as claimed in claim 14, further comprising a container having a construction to maintain said tool in a water-infiltrated condition after detaching of said tool from said apparatus.

22. An apparatus as claimed in claim 14, further comprising a portable storage container having a construction to maintain said tool, when not mounted in said apparatus, under water or in a moistened condition.

23. An apparatus as claimed in claim 22, further comprising an anti-microbial substance added to said container.

24. An apparatus as claimed in claim 23, wherein said anti-microbial substance comprises ethanol.

25. An apparatus as claimed in claim 22, wherein said tool is stored in said container at a controlled predetermined temperature range.

26. An apparatus as claimed in claim 22, wherein said container has a cover for liquid tight sealing and opening and closing of said container.

* * * * *